United States Patent [19]

Beloate et al.

[11] 4,434,896

[45] Mar. 6, 1984

[54] TAMPER-RESISTANT RECLOSABLE PACKAGE

[75] Inventors: Mickey R. Beloate, Memphis; Harley E. Erb, Germantown; Charles W. Shelton, Memphis, all of Tenn.

[73] Assignee: Plough, Inc., Memphis, Tenn.

[21] Appl. No.: 490,618

[22] Filed: May 2, 1983

[51] Int. Cl.[3] ..... B65D 5/54; B65D 55/02

[52] U.S. Cl. ..... 206/621; 206/807; 229/39 R; 229/45 R

[58] Field of Search ..... 206/621, 622, 625, 807; 229/37, 39 R, 45

[56] References Cited

U.S. PATENT DOCUMENTS

| | | | |
|---|---|---|---|
| 1,992,195 | 2/1935 | Daller | 206/625 |
| 2,002,364 | 5/1935 | Daller | 206/622 |
| 3,462,066 | 8/1969 | Farquhar | 206/807 |
| 4,201,292 | 5/1980 | Davidson et al. | 206/621 |
| 4,344,533 | 8/1982 | Olsen | 206/621 |

*Primary Examiner*—William T. Dixson, Jr.

*Attorney, Agent, or Firm*—Robert S. Salzman; Bruce M. Eisen

[57] ABSTRACT

Disclosed is a tamper-resistant reclosable package containing highly visible tamper indicators.

8 Claims, 7 Drawing Figures

TAMPER-RESISTANT RECLOSABLE PACKAGE

BACKGROUND OF THE INVENTION

The present invention relates to a tamper-resistant reclosable package. In particular, the instant invention relates to a reclosable package with highly visible tamper indicators on the package.

Tamper-resistant packaging has lately received an increased emphasis in consumer protection. In particular, it is critically important that any tamper-resistant packaging contain visible tamper indicator(s) which will readily warn the consumer of tampering to the package. It is particularly desirable that the tamper-resistant package be conveniently reclosable for later use.

Several types of tamper-resistant reclosable packaging are known in the art. U.S. Pat. Nos. 3,191,848; 3,484,036 and 3,893,614 disclose tamperproof reclosable cartons. Each of these patents teach a tamperproof carton which has the opening means hidden beneath a skirted portion in the closed carton. These carbons do not contain any visible tamper indicators. In fact, the box opening is hidden.

The package of the present invention is not only reclosable but contains highly visible tamper indicators.

The present invention relates to a package blank having top and bottom portions and which is suitably cut and scored comprising (a) a series of generally rectangular package panel walls hingedly connected at lateral edges by parallel score lines, said series including front and rear panel walls, a pair of side panel walls, and a glue panel hinged to a lateral edge of one of said side walls, a first closure end panel at said top portion having first and second ends is hingedly connected and removably engagable at its first end from said front panel wall, a second closure end panel at said top portion also having first and second ends is hingedly connected at its first end to said rear panel wall, a flap is hingedly connected at said second end of said second closure end panel, said first closure end panel having near its first end a generally longitudinal disposed line of weakness extending the length thereof and parallel to said first end which together with said hingedly connected and removably engagable first end defines a potential tear path therein; said first closure end panel also contains behind said weakening line at least one cut or weakening score on the surface of said end closure panel and in close proximity with said second end and which together with said second end define distortable bridges; (b) tamper-resistant closure means for said bottom end.

DETAILED DESCRIPTION OF THE DRAWING

Figure 1:
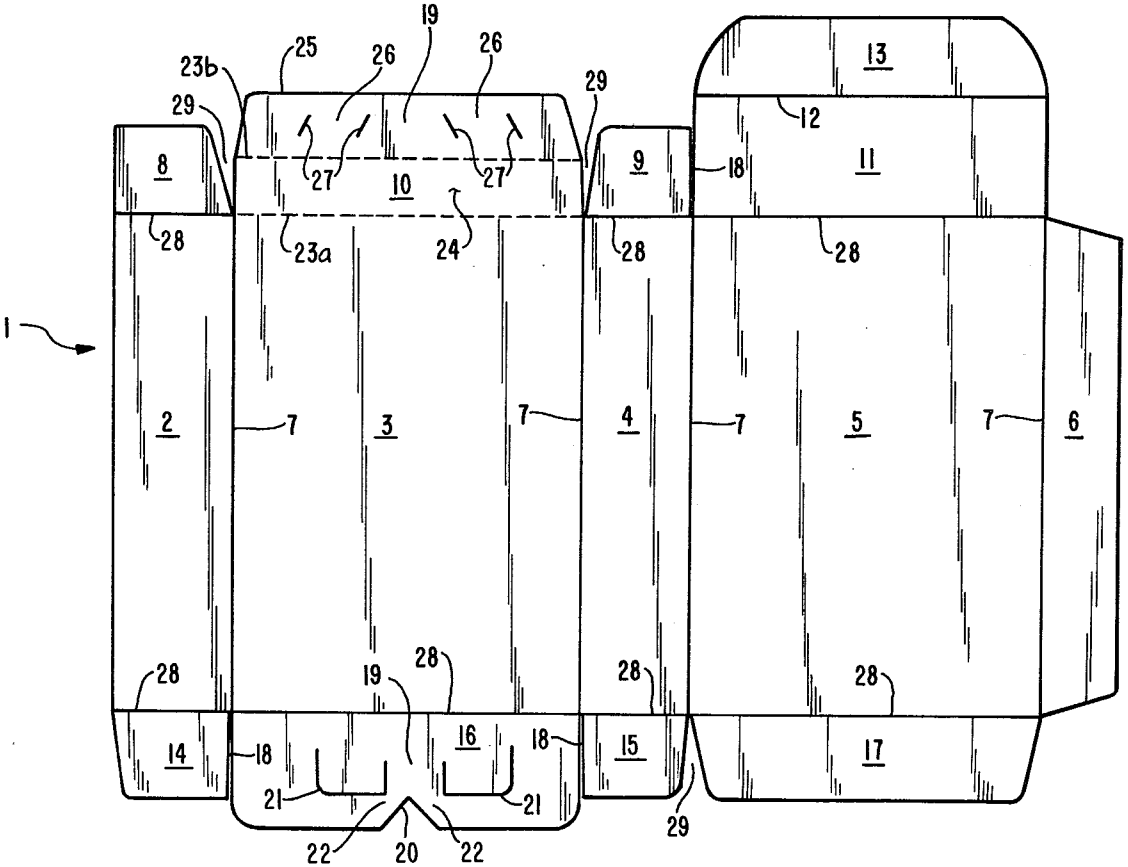
FIG. 1 is a plan view of a package blank of this invention.

FIG. 1 shows package blank 1 having front and rear panel walls 3 and 5 respectively, and side panel walls 2 and 4 with a glue flap 6 on the rear panel wall 5 adapted to be glued to the side panel wall 2 to form the tubular center portion of the package. Score lines 7 are provided between the panel walls and the flap to provide weakened fold lines. Side panel walls 2 and 4 and front and rear panel walls 3 and 5 respectively contain top closure end panels 8, 9, 10 and 11 and bottom closure end panels 14, 15, 16 and 17. Top closure end panels 8 and 9 are separated from top closure end panel 10 by notches 29. Bottom closure end panels 14 and 15 are separated from bottom closure end panel 16 by cuts 18. Top closure end panel 11 is separated from top closure end panel 9 by cut 18 while bottom closure end panel 17 is separated from bottom closure end panel 15 by notch 29. Once the tubular center is formed by folding along score lines 7 and gluing flap 6 to side panel wall 2, the package may then be closed by folding along score lines 28. The bottom is formed by first folding inward bottom closure end panels 14 and 15 while bottom closure end panel 17 is then next folded on top of bottom closure end panels 14 and 15. Bottom closure end panel 16 is folded on top of and adhesively attached to bottom closure end panel 17. Bottom closure end panel 17 serves as the underportion to bottom closure end panel 16 when bottom closure end panel 16 is folded on top of bottom closure end panel 17. Bottom closure end panel 16 is provided with two curved cuts, 21, and an indentation, 20, resulting in two narrowed bridges, 22. The top of the package is closed by folding inward along score lines 28 and perforation lines **23*a*. The top is formed by first folding inward top closure end panels 8 and 9. Top closure end panel 11 contains a flap 13 which folds along score line 12. The flap 13 is tucked into the interior of the package while top closure end panel 11 is placed over top closure end panels 8 and 9. Alternatively, flap 13 may be folded under closure end flap 11 and then folded on top of closure end flaps 8 and 9. Lastly, top closure end panel 10 is folded on top of and adhesively attached to the top of top closure end panel 11. Top closure end panel 11 serves as the underportion to top closure end panel 10 when top closure end panel 10 is folded on top of top closure end panel 11. Top closure end panel 10 contains two parallel rows of perforations 23*a* and 23*b* which form a removable tear strip 24. The top closure end panel also contains tamper indicators which on the preferred embodiment are cuts 27. The cuts 27 together with the front of the end panel 25 create weakened distortable bridges 26 which when torn or disfigured warn of tampering to the package. In order to increase the effectiveness of the tamper indicators, end panel 10 and 16 are preferably adhesively attached to end panel 11 and 17 respectively in the area 19**.

Figure 2:
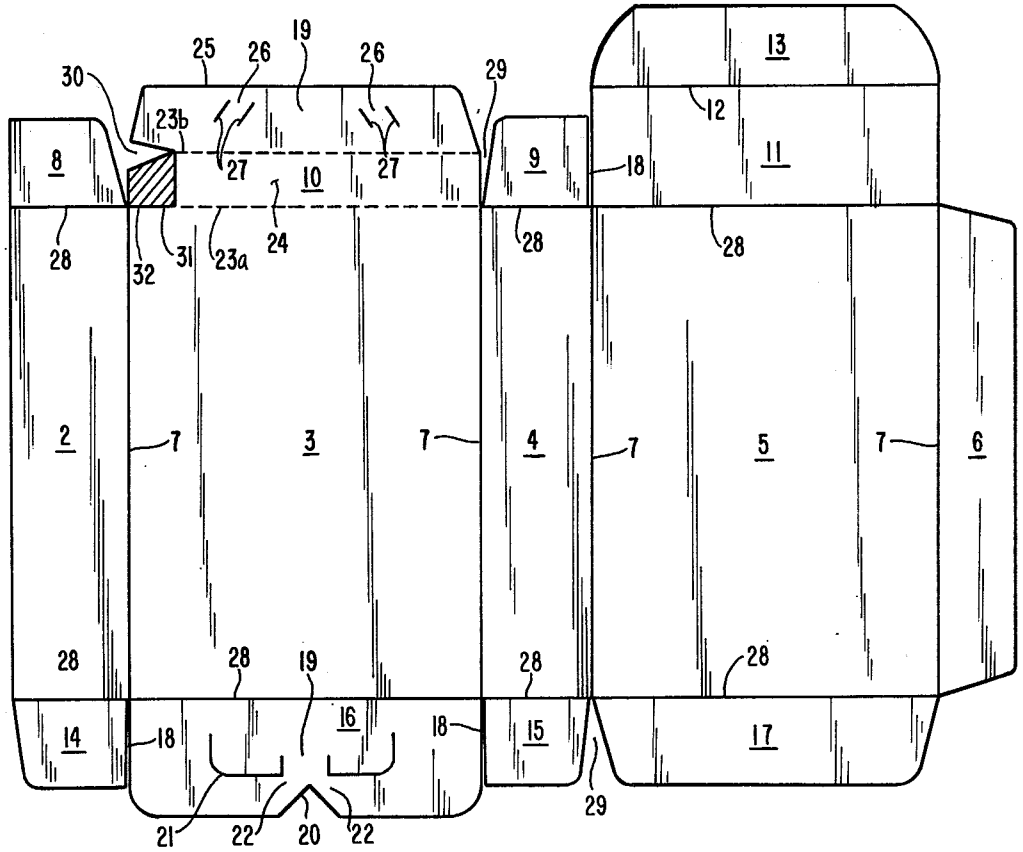
FIG. 2 is a plan view of a package blank comprising a preferred embodiment of this invention.

FIG. 2 is a plan view of a preferred package blank of this invention. Tear strip 24 contains a tab 31. Tab 31 is separated from the remainder of closure end panel 10 by notch 30 which allows for an easy grasp of the tab and facilitates removal of the tear strip from the package. Bottom perforation **23*a* may extend the length of the front panel 3 or it may terminate at the tab whereupon the tab 31 may be separated from the front panel 3 by cut 32**.

Figure 3:
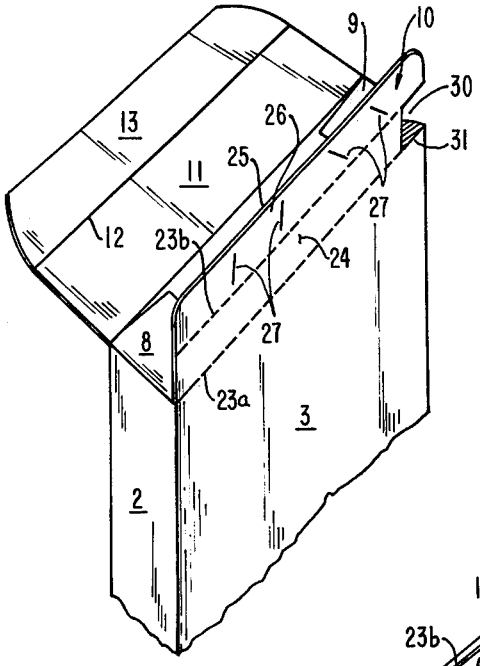
FIG. 3 is a fragmentary perspective view of the package at one stage during the closure and sealing procedure.

FIG. 3 is a fragmentary perspective view of a partially closed package. Top closure end panels 8 and 9 are folded inward onto the tubular center of the package. Closure end panel 11 will then be folded downward on top of closure end panels 8 and 9 with flap 13 to be tucked downward into the interior of the package. Closure end panel 10 is then folded on to the top of closure end panel 11 and is adhesively attached thereto.

Figure 4:
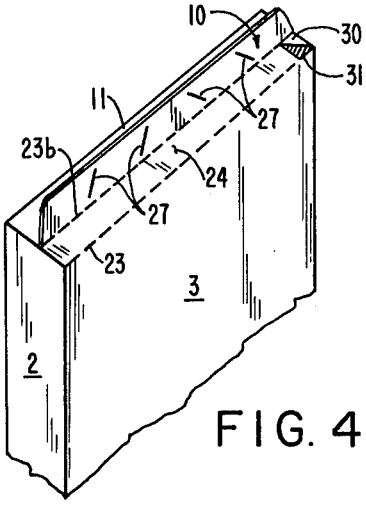
FIG. 4 is a fragmentary perspective view of the sealed package.

FIG. 4 is a fragmentary perspective view of a closed package. Notch 30 allows easy access to tab 31 which may now be grasped between the index finger and thumb. By pulling from right to left on tab 31, tear strip 24 is readily removed.

Figure 5:
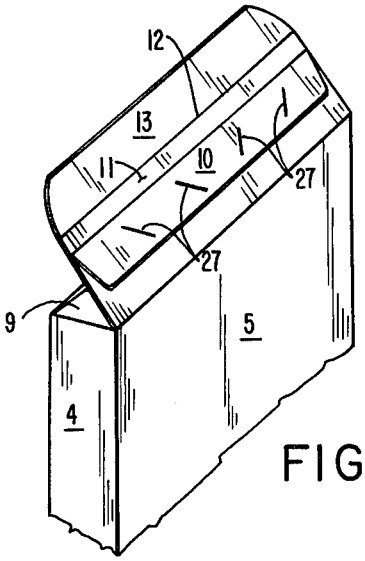
FIG. 5 is a fragmentary perspective view of the package after opening.

FIG. 5 is a fragmentary prospective view of an opened package. The tear strip 24 together with tab 31 is removed from the package leaving only the remainder of closure end panel 10 still adhesively attached to closure end panel 11. Flap 13 together with score line 12 allow for facile reclosing of the package.

Figure 6:
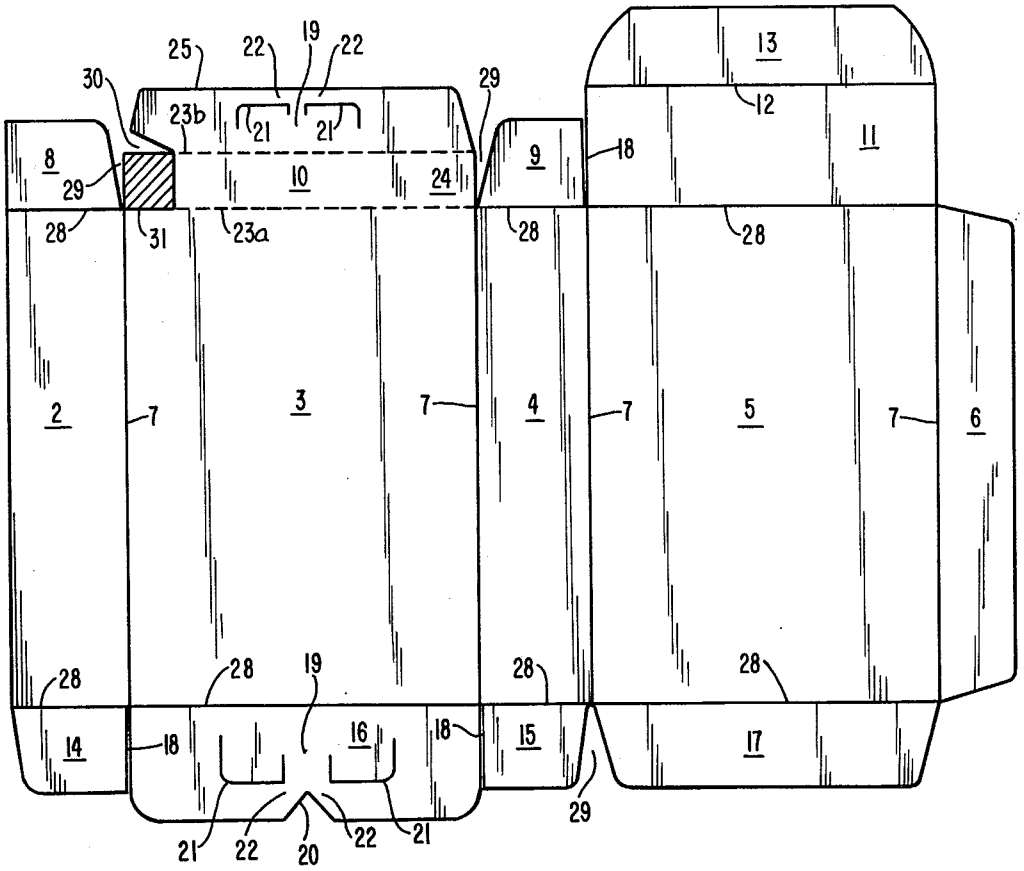
FIG. 6 is a plan view of a package blank comprising another embodiment of this invention.

FIG. 6 is a plan view of an alternative embodiment of this invention. Top closure end panel 10 is provided with two curved cuts 21. Due to the close proximity of the curved cuts with the front, 25, of closure end panel, 10, two narrowed and thus weakened bridges 22 result. These distortable bridges result in highly visible tamper indicators.

Figure 7:
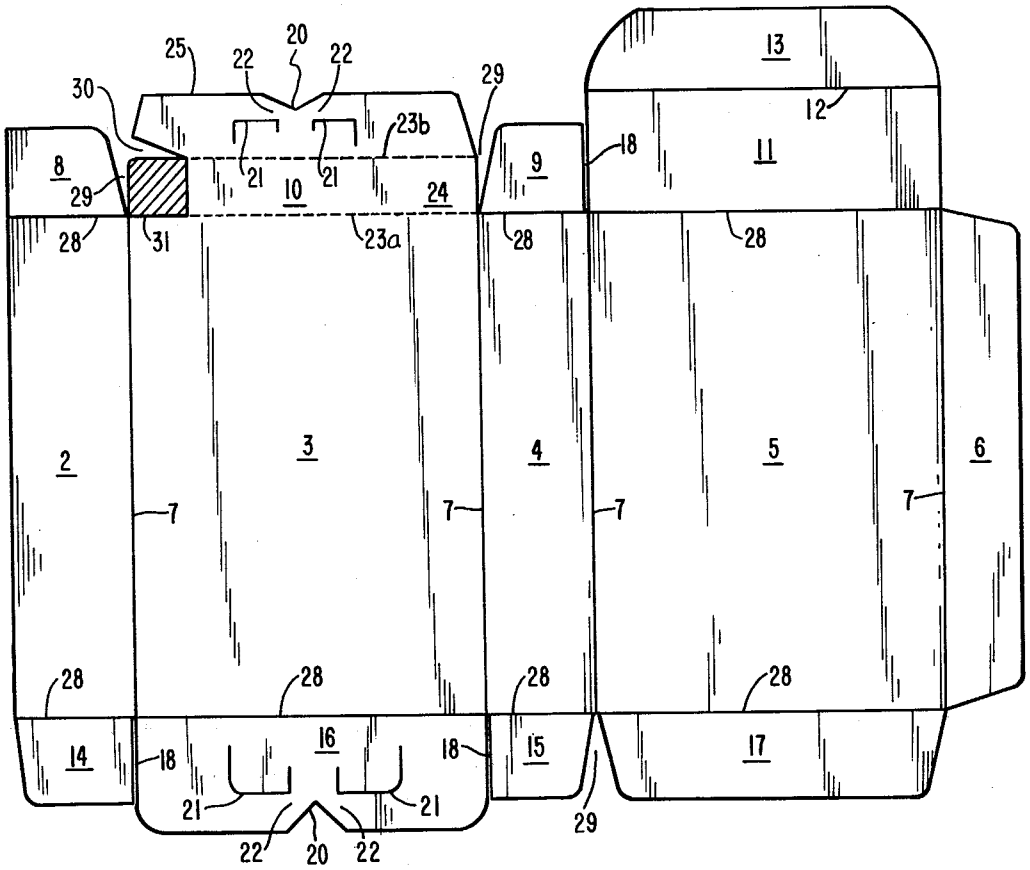
FIG. 7 is a plan view of a package blank comprising still another embodiment of this invention.

FIG. 7 is a plan view of still another embodiment of this invention. In this embodiment, indentation 20 is provided between the curved cuts, 21. This embodiment is preferred whenever greater distortability of the resulting bridges, 22 is desired.

The term "curved cuts" includes all cuts other than those which are a single straight line.

The term "adhesively attached" is understood to mean fastened by an adhesive such as glue, tape and the like. For instance, in a plastic container, the closure end panel 10 may be fastened to closure end panel 11 by heat sealing.

The term "removably engagable" is understood to mean easily removed by pulling, tearing and the like.

The first closure end panel is hingedly attached and removably engagable at its first end from the front panel wall. This first end of said first closure end panel together with a generally longitudinally disposed line of weakness form a readily removable tear strip. Generally, the tear strip is formed by perforation although other means such as weakening lines and the like may also be employed.

Generally, the disposed line of weakness is in close proximity to said first end of said closure end panel to facilitate removal of the tear strip. Preferably, said disposed line of weakness is within from 0.1 to 2.0 inches of said first end of said closure end panel.

The distortable bridges created by the cut(s) placed on closure end panel 10 serve as easily tearable members. Whenever torn or disfigured, these highly visible members expose tampering to the package.

Generally, 1 to 6 curved or straight cuts are placed on closure end panel 10. Due to the ease of manufacture, it is generally preferred that straight cut(s) are employed. It is particularly preferred that 4 straight cuts are utilized in this invention.

The straight cuts may be placed at any angle to the front, 25, of closure end panel 10. Preferably, the straight cuts are placed at angles ranging from 0° (parallel to front, 25) to 70° to the front, 25, of closure end panel 10 (measuring the angle to give it the lowest possible value). When the straight cuts are angled, they generally extend from 5% to 50% of the length of closure end panel 10 of the package (measuring from front panel 3 to back panel 5) and generally terminate within close proximity of the front, 25, of said end panel. Preferably they terminate within 0.01 to 1 inch of the front, 25, of said closure end panel. The length of these straight cuts is restricted by the tearable strip 24 also placed on closure end panel 10.

So long as the cuts are arranged to form easily distortable bridges, the straight cuts may be placed parallel to one another, at angles to one another or at some combination of both (i.e., 1 group of 3 straight cuts wherein the cuts are parallel to one another in that group but which are at an angle to another similar group of three straight cuts).

Each straight cut generally extends from 2% to 70% of the width of the package. Preferably, when 4 straight cuts are employed, each cut generally extends from 2% to 20% of the width of the package.

In the embodiment wherein curved cuts are employed, it is preferred that 2 curved cuts be utilized. The curved cuts generally extend lengthwise from 5% to 60% of the package while extending widthwise from 10% to 70% of the package. The curved cuts are placed in close proximity to the front, 25, of closure end panel 10 or to the indentation, 20, in order to create distortable bridges, 22.

Preferably, when employed, the indentation, 20, in closure end panel 10 extends from 5% to 25% of the width of the closure end panel.

The package of the present invention will generally be made of cardboard but similar materials such as plastic, paper and the like that have sufficient strength to serve as a container but which still may be easily torn may be substituted.

The shape of the package is not critical as long as the tamper-resistant closure flap described is employed. However, a rectangular package design is preferred.

Although, in one embodiment, both the upper and lower closures may be tamper-resistant and reclosable, it is preferred that only the top closure be tamper-resistant and reclosable. As illustrated in FIGS. 1, 2, 6 and 7, the bottom closure (end panel 19) should be tamper-resistant. The manner described in copending application U.S. Ser. No. 452,350 which is incorporated herein by reference is preferred. Other means for making the bottom closure tamper-resistant are known in the art and include packages having no means of access through the bottom.

In the preferred embodiment, tear strip 24 is readily removable by perforations 23. However, in another embodiment, weakened score lines or any other means which allow ready separation may be used in place of perforations.

By the term "in close proximity" is meant within 0.01 to 1 inch of the curved cuts.

We claim:

1. A package blank having top and bottom portions which is suitably cut and scored, comprising: (a) a series of generally rectangular package walls hinged at lateral edges by substantially parallel score lines, said package walls including front and rear panel walls, a pair of side panel walls, and a glue panel hinged to a lateral edge of one of said side walls, a first closure and panel at said top portion having first and second ends, said second end hinged to said rear panel wall and said first end removably engagable from said front panel wall; a second closure end panel at said top portion also having first and second ends, said first end hinged to said rear panel wall, a flap hinged to the second end of said second closure and end panel, said second closure end panel closing in an opposite direction to said first closure end panel, whereby said first closure end panel can be torn or damaged while maintaining the structural integrity of said second closure end panel, said first closure end panel having near its first end a generally longitudinally disposed line of weakness substantially extending the length thereof and substantially parallel to said first end which together with said hingedly connected and removably engagable first end defines a potential tear path therein; said first closure end panel also containing behind said weakening line, at least one cut or weakening score on a surface of said end closure panel adjacent to said second end, and which together with said second end defines a distortable bridge; and (b) tamper-resistant closure means for said bottom portion.

2. A tamper-resistant reclosable package having top and bottom portions, comprising: (a) a consecutively articulated first side panel wall, front panel wall, second side panel wall, rear panel wall and a glue flap attached to said rear panel wall and adhesively attached to said first side panel wall to form a substantially rectangular center portion of said package; a first closure end panel at said top portion having first and second ends, said first closure end panel removably engagable at its first end to said front panel wall and hinged at its second end to said rear panel wall; a second closure and panel at said top portion having first and second ends, said first end hinged to said rear panel wall, a flap hinged at the second end of said second closure end panel, said second closure end panel closing in an opposite direction to said first closure end panel, whereby said first closure end panel can be torn or damaged while maintaining the structural integrity of said second closure end panel, said first closure end panel having near its first end a generally longitudinally disposed line of weakness substantially extending the length thereof and substantially parallel to said first end which together with said removably engagable first end defines a potential tear path therein; said first closure end panel also containing behind said weakening line, at least one cut or weakening score on a surface of said end closure panel adjacent to said second end, and which together with said second end defines a distortable bridge; and (b) tamper-resistant closure means for said bottom portion.

3. The tamper-resistant reclosable package defined in claim 2, wherein said second end of said first closure end panel is hinged to said front panel wall by perforations.

4. The tamper-resistant reclosable package defined in claim 3, wherein said generally longitudinally disposed line of weakness is formed by perforations.

5. The tamper-resistant reclosable package defined in claim 2 wherein said first closure end panel contains behind said weakening line one to six cuts or weakening scores on a surface of said first end closure panel in close proximity with said second end, and which together with said second end, defines a distortable bridge.

6. The tamper-resistant reclosable package defined in claim 5 wherein said cuts are substantially straight.

7. The tamper-resistant reclosable package defined in claim 5 wherein two curved cuts are employed.

8. The tamper-resistant reclosable package defined in claim 7 wherein an indentation is disposed adjacent to said two curved cuts.

* * * * *